US007378617B1

(12) United States Patent
Brockman

(10) Patent No.: US 7,378,617 B1
(45) Date of Patent: May 27, 2008

(54) HEATING SYSTEMS AND METHODS FOR A COOKING APPLIANCE

(75) Inventor: Sherry Leigh Layne Brockman, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/637,414

(22) Filed: Dec. 11, 2006

(51) Int. Cl.
*A21B 1/22* (2006.01)
*A47J 27/00* (2006.01)

(52) U.S. Cl. ..... 219/398; 219/391; 219/395; 219/400; 219/408; 219/410; 219/476; 219/477; 219/480; 219/409; 99/467; 99/468; 99/474; 99/325; 99/330; 126/21 A

(58) Field of Classification Search ..... 219/391, 219/395, 398, 400, 408–410, 476–7, 480; 126/21 A; 99/467–8, 325, 330
See application file for complete search history.

(56) References Cited

U.S. PATENT DOCUMENTS 3,128,363 A * 4/1964 Rose, Jr. et al. ..... 219/392
5,239,917 A 8/1993 Lutkie et al.
5,695,668 A * 12/1997 Boddy ..... 219/400
6,291,808 B1 9/2001 Brown
6,486,453 B1 11/2002 Bales et al.
6,566,638 B2 5/2003 Brown
6,603,102 B2 8/2003 Brown et al.
6,630,650 B2 10/2003 Bassill et al.
6,817,283 B2 11/2004 Jones et al.
7,109,447 B2 9/2006 Goranson
7,109,448 B2 9/2006 Goranson
7,235,763 B2 6/2007 Christiaansen et al.

* cited by examiner

*Primary Examiner*—Shawntina Fuqua
(74) *Attorney, Agent, or Firm*—George L. Rideout, Esq.; Armstrong Teasdale LLP

(57) ABSTRACT

A heating system for a cooking appliance includes a first upper heating element and a second upper heating element positioned within a cooking cavity defined by a cabinet of the cooking appliance. The cooking cavity is configured to support a food item therein during a cooking process. Each of the first upper heating element and the second upper heating element is positioned with respect to an upper portion of the food item. A lower heating element is positioned within the cooking cavity. The lower heating element is positioned with respect to a bottom portion of the food item. A controller is operatively coupled to the lower heating element and the first and second upper heating elements. The controller is configured to asynchronously energize the first upper heating element and the second upper heating element to heat the upper portion of the food item.

18 Claims, 4 Drawing Sheets

HEATING SYSTEMS AND METHODS FOR A COOKING APPLIANCE

BACKGROUND OF THE INVENTION

This invention relates generally to cooking appliances and, more particularly, to heating systems and methods for cooking food items.

Conventional cooking appliances, including ranges and ovens, have a cabinet that defines a cooking cavity within which food items are placed. A plurality of heating elements are positioned within the cooking cavity for cooking the food items. Some conventional cooking appliances use programmed cooking algorithms to cook the food items placed within the cooking cavity. However, conventional cooking appliances may not cook particular food items, such as a pizza, to obtain an optimum result by using a general cooking algorithm designed for all foods. For example, it may desirable to cook the dough portion of the pizza more thoroughly or at a higher temperature than a toppings portion of the pizza. A uniform high cooking temperature used in the general cooking algorithm may thoroughly cook the dough but burn the toppings of the pizza. In addition, frozen pizza and fresh dough pizza may require different cooking algorithms for an optimum cooking result.

BRIEF DESCRIPTION OF THE INVENTION

In one aspect, a heating system for a cooking appliance is provided. The cooking appliance includes a cabinet defining a cooking cavity. The cooking cavity is configured to support a food item therein during a cooking process. The heating system includes a first upper heating element and a second upper heating element positioned within the cooking cavity. Each of the first upper heating element and the second upper heating element is positioned with respect to an upper portion of the food item. A lower heating element is positioned within the cooking cavity. The lower heating element is positioned with respect to a bottom portion of the food item. A controller is operatively coupled to the lower heating element and the first and second upper heating elements. The controller is configured to asynchronously energize the first upper heating element and the second upper heating element to heat the upper portion of the food item.

In another aspect, a cooking appliance includes a cabinet at least partially defining a cooking cavity. The cooking cavity is configured to support a food item therein during a cooking process. A first upper heating element and a second upper heating element are positioned within the cooking cavity. Each of the first upper heating element and the second upper heating element is positioned with respect to an upper portion of the food item. A lower heating element is positioned within the cooking cavity. The lower heating element is positioned with respect to a bottom portion of the food item. A controller is in operational control communication with each of the lower heating element, the first upper heating element and the second upper heating element. The controller is configured to alternately energize the first upper heating element and the second upper heating element to heat the upper portion of the food item.

In another aspect, a method for operating an oven is provided. The method includes providing a cabinet defining a cooking cavity. The cooking cavity is configured to receive a food item therein. The method includes positioning a first upper heating element, a second upper heating element and a lower heating element within the cooking cavity. Each of the first upper heating element and the second upper heating element is positioned with respect to an upper portion of the food item, and the lower heating element is positioned with respect to a bottom portion of the food item. The method also includes operatively coupling a controller to the lower heating element, the first upper heating element and the second upper heating element. The controller is configured to alternately energize the first upper heating element and the second upper heating element to heat an upper portion of the food item.

DETAILED DESCRIPTION OF THE INVENTION

Figure 1:
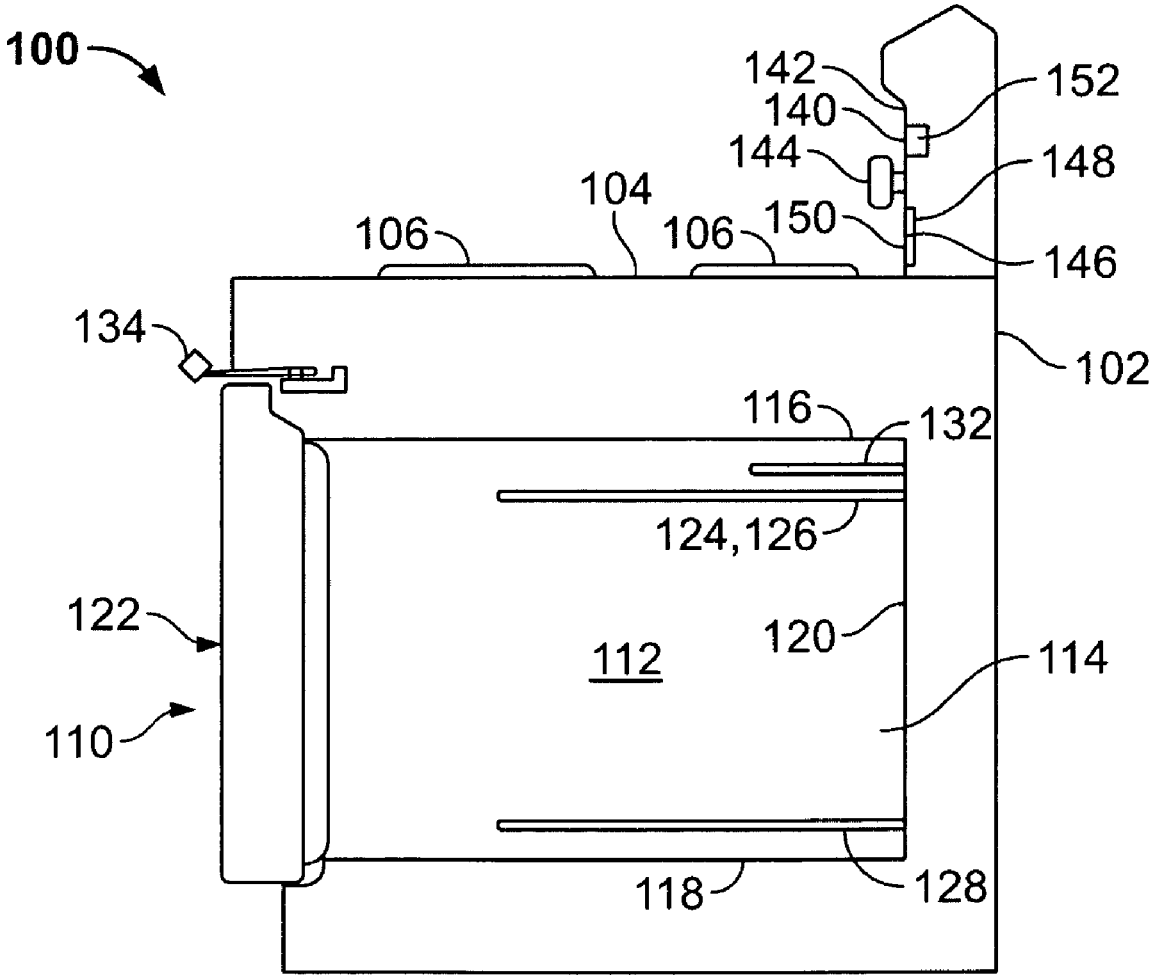
FIG. 1 is a partial sectional view of an exemplary cooking appliance.

FIG. 1 illustrates a cooking appliance in the form of a free standing range 100 including an outer body or cabinet 102 that incorporates a generally rectangular electrical cooktop 104. Range 100 includes a lower oven 106 positioned within cabinet 102 and an upper oven 108 positioned over lower oven 106 and within cabinet 102. Lower oven 106 defines a lower oven cavity 110. A front-access lower oven door 112 is configured to sealingly cover lower oven cavity 110. Similarly, upper oven 108 defines an upper oven cavity 114. A front-access upper oven door 116 is configured to sealingly cover upper oven cavity 114. A range backsplash 120 extends upward of a rear edge 122 of cooktop 104 and includes, for example, a control display and control selectors for user manipulation for facilitating selecting operative oven features, cooking timers, time and/or temperature displays.

Cooktop 104 includes a left front burner 124, a right front burner 126, a left rear burner 128, a right rear burner 130, and a center rear burner 132 positioned between burners 128 and 130. In one embodiment, burners 124, 128, 130, 132 are single element heaters, and burner 126 is a triple element heater capable of heating in different modes. It should be apparent to those skilled in the art and guided by the teachings herein provided that cooktop 104 may include any suitable number of heating elements, any suitable type of heating elements (i.e., single, double or triple element) and/or any suitable arrangement of the heating elements.

Further, it should be apparent to those skilled in the art and guided by the teachings herein provided that the present invention is applicable, not only to range 100 having an electrical cooktop, but also to any suitable cooking appliance including, without limitation, counter top cooking appliances, built-in cooking appliances and multiple fuel cooking appliances. Therefore, range 100 is provided by way of illustration rather than limitation, and accordingly there is no intention to limit application of the present invention to any particular appliance or cooktop, such as range 100 or cooktop 104.

FIG. 1 illustrates an exemplary cooking appliance in the form of a free standing range 100 suitable for use with the present invention. Range 100 includes an outer cabinet 102 with a top cooking surface 104 having individual surface heating elements 106, and an electric oven 110 positioned below cooking surface 104. It should be apparent to those skilled in the art and guided by the teachings herein provided that the present invention is suitable for use, not only with ovens that form a portion of a range, such as range 100, but with any suitable cooking appliance including, without limitation, free standing ovens and wall-mounted ovens. Further, in alternative embodiments, microwave ovens and other suitable heating ovens are employed in lieu of electric oven 110.

Positioned within outer cabinet 102 is a cooking chamber or cavity 112 defined at least partially by an oven liner having side walls 114, a top wall 116, a bottom wall 118, a rear wall 120 and a front opening 121. A drop door 122 sealingly closes front opening 121 during a cooking process. Cooking cavity 112 is configured to receive and support a food item (not shown), such as a pizza, during the cooking process. Cooking cavity 112 is provided with a first upper heating element 124, such as a first broil heating element, and a second upper heating element 126, such as a second broil heating element, positioned at or near top wall 116. A lower heating element 128, such as a bake heating element, is positioned at or near bottom wall 118.

In an alternative embodiment (not shown), range 100 includes more than one cooking chamber or cavity. For example, in an exemplary alternative embodiment, range 100 includes a second cooking chamber or cavity positioned below or above cooking cavity 112. The second cooking cavity may be configured substantially similar to first cooking cavity 112 or may be configured differently. Additionally, the second cooking cavity may be substantially similar in size to first cooking cavity 112 or may be larger or smaller than first cooking cavity 112. A drop door sealingly closes a front opening of the second cooking chamber during the cooking process. Further, the second cooking chamber is equipped with one or more suitable heating elements, such as a first upper heating element and a second upper heating element positioned at or near a top wall and/or a lower heating element positioned at or near a bottom wall, as described above in reference to first cooking cavity 112.

Figure 2:
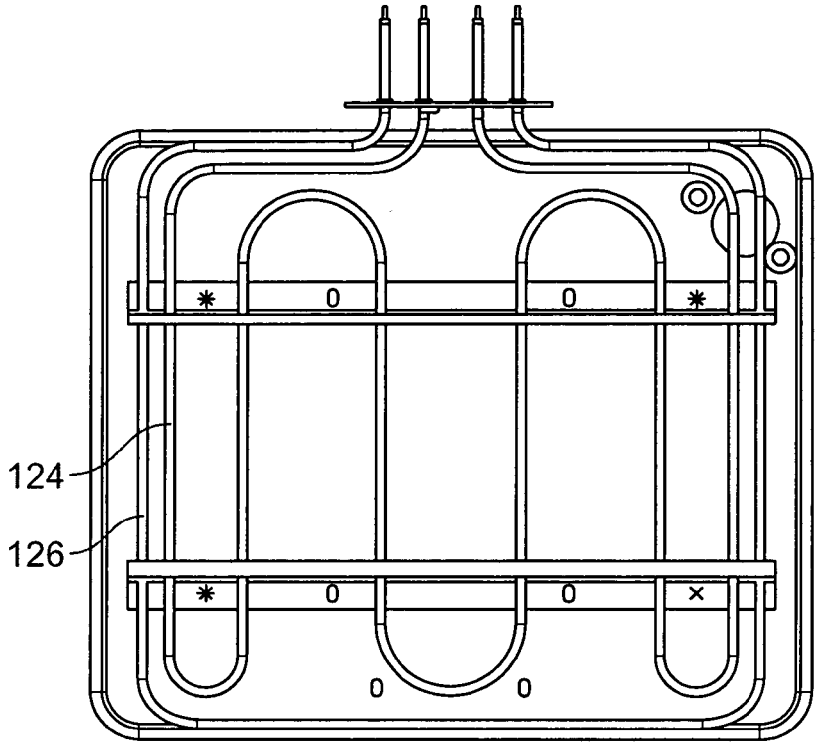
FIG. 2 is a plan view of two exemplary heating elements suitable for use with the cooking appliance shown in FIG. 1.
Figure 3:
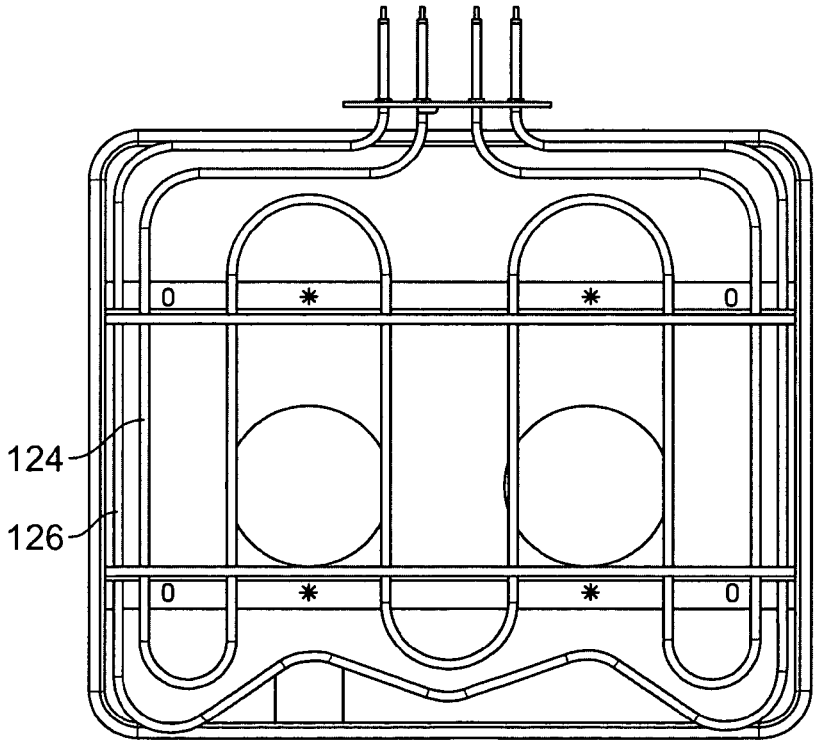
FIG. 3 is a plan view of two alternative exemplary heating elements suitable for use with the cooking appliance shown in FIG. 1.

FIG. 2 is a plan view of exemplary upper heating elements 124, 126. FIG. 3 is a plan view of alternative exemplary upper heating elements 124, 126. In one embodiment, second upper heating element 126 is substantially circular or arcuate in shape, and first upper heating element 124 is positioned within an area defined by second upper heating element 126. As such, second upper heating element 126 at least partially surrounds first upper heating element 124. It should be apparent to those skilled in the art and guided by the teachings herein provided that the shape and/or the configuration of upper heating elements 124 and/or 126 may be varied for desired or selected applications in alternative embodiments.

In the exemplary embodiment, first upper heating element 124 and second upper heating element 126 are generally planar, as shown in FIG. 2, and positioned within cooking cavity 112 in a coplanar configuration. In this embodiment, first and second upper heating elements 124, 126 are positioned with respect to an upper portion or area of the food item. Further, lower heating element 128 is positioned with respect to a lower portion or area of the food item. As such, first and second upper heating elements 124, 126 are energized to heat the upper portion of the food item, as desired, and lower heating element 128 is energized to heat the lower portion of the food item, as desired. In one embodiment, upper heating elements 124, 126 and/or lower heating element 128 include electrical heating elements. In alternative embodiments, gas-fired heating elements, microwave heating elements and/or other suitable heating elements.

A temperature probe or sensor 132 is mounted with respect to cavity 112 to sense a temperature within cooking cavity 112. In one embodiment, sensor 132 is positioned between upper heating elements 124, 126 and top wall 116. In alternative embodiments, sensor 132 is positioned at any suitable location within cooking cavity 112, such as between lower heating element 128 and upper heating elements 124, 126. In one embodiment, a door latch 134 is configured to lock door 122 in a closed position during a cooking process and/or a self-cleaning operation.

A control panel 140 is coupled to a backsplash 142 of range 100. At least one control knob 144 is operatively coupled to control panel 140. In one embodiment, a plurality of input selectors 146 are mounted on or within an outer surface of control panel 140. In one embodiment, at least one input selector 146 is labeled "PIZZA" and is actuated to activate a pizza cooking mode for oven 110. In a particular embodiment, "PIZZA" selector 146 includes a "FRESH DOUGH PIZZA" selector 148, and a "FROZEN PIZZA" selector 150. At least one additional input selector 143 may be provided for selecting a cooking power level, such as "HIGH", "MEDIUM", and/or "LOW".

A controller 152 is coupled to control panel 142 for controlling the operation of range 100 and/or oven 110 according to a user's selection through control knob 140 and/or input selectors 146, 148, 150. Controller 152 is coupled in signal communication with sensor 132 for receiving signals representative of a detected cavity temperature from sensor 132. Controller 146 is also coupled in operational control communication with upper heating elements 124, 126 and lower heating element 128 for controlling the heating operation of upper heating elements 124, 126 and/or lower heating element 128 during a cooking process.

When the food item (not shown), such as a pizza, is positioned within cooking cavity 112, first and second upper heating elements 124, 126 may be energized to heat the upper portion of the pizza. In a particular embodiment, first upper heating element 124 is energized to generate a substantially even heat to an inner area of the upper portion of the pizza, e.g., the toppings of the pizza. Second upper heating element 126 is energized to generate a substantially even heat to an outer area of the upper portion of the pizza that surrounds at least a portion of the inner area, e.g., the pizza dough.

Figure 4:
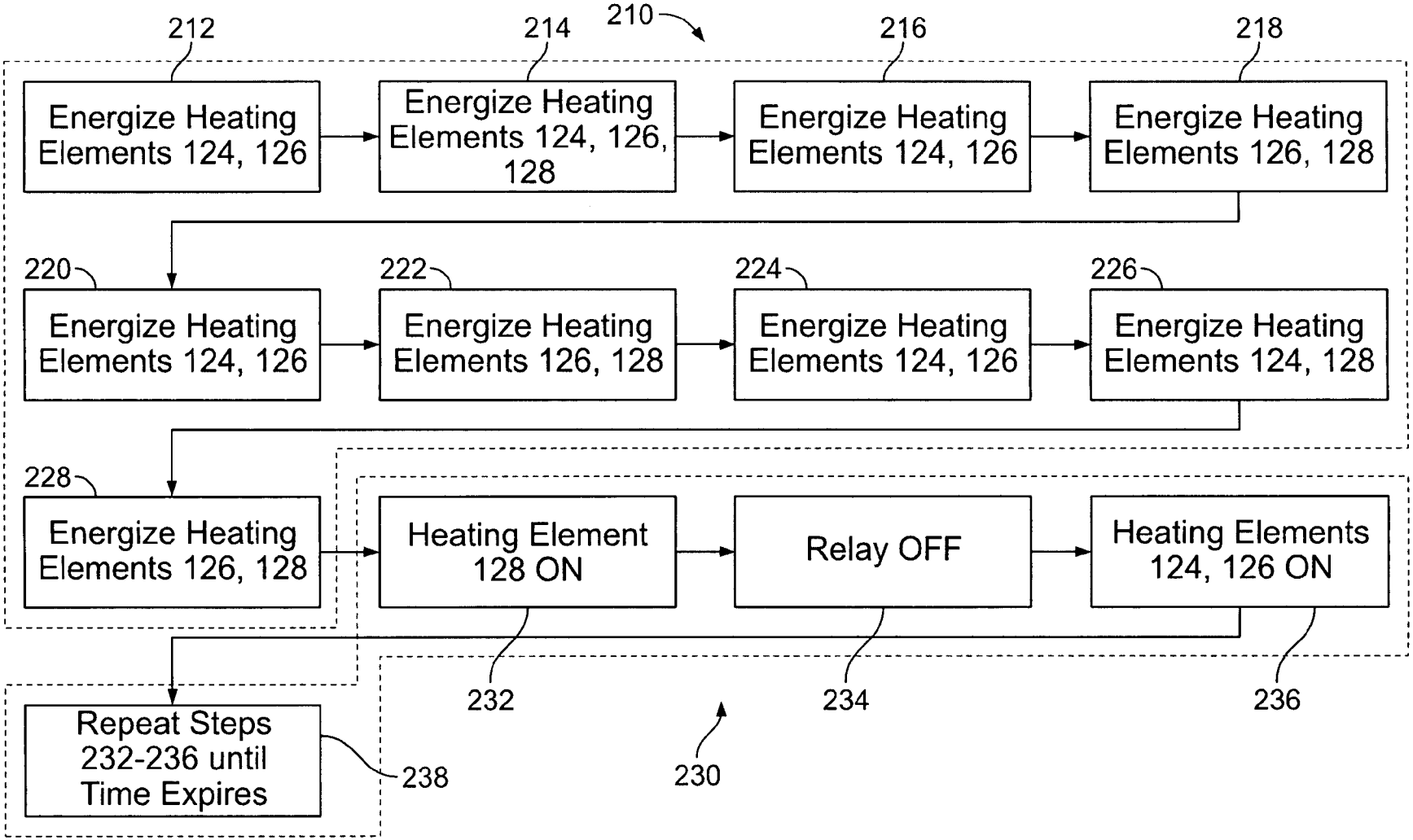
FIG. 4 is a flow chart of an exemplary fresh pizza mode for the cooking appliance shown in FIG. 1.
Figure 5:
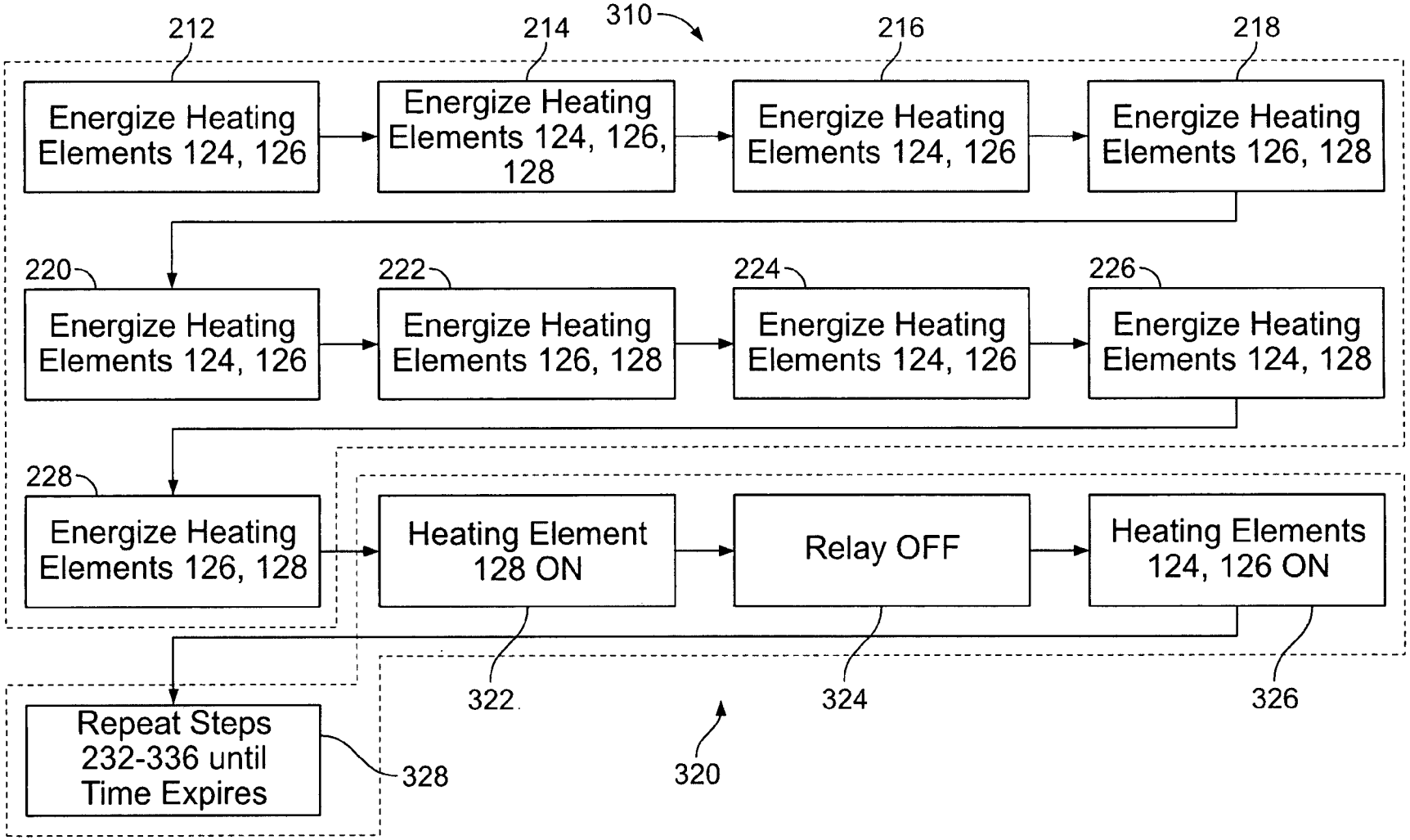
FIG. 5 is a flow chart of an exemplary frozen pizza mode for the cooking appliance shown in FIG. 1.

FIG. 4 is a flow chart of an exemplary fresh pizza mode suitable for use in cooperation with oven 110 shown in FIG. 1. FIG. 5 is a flow chart of an exemplary frozen pizza mode suitable for use in cooperation with oven 110.

Oven 110 is selectively operable in the fresh pizza mode and the frozen pizza mode. A user inputs a desired temperature or temperatures at which the pizza is cooked through at least one input selector 143, shown in FIG. 1. In a particular embodiment, the user selects the "FRESH DOUGH PIZZA" selector 148 or "FROZEN PIZZA" selector 150 to input the pizza temperature selection. Controller 152 then initiates the corresponding fresh pizza mode or the frozen pizza mode to cook the pizza positioned within cooking cavity 112.

In one embodiment, the user inputs a desired cooking time and/or a desired cooking temperature for performing the fresh pizza mode or the frozen pizza mode. In an alternative embodiment, the cooking time and/or the cooking temperature is programmed based on a selection of the fresh pizza mode or the frozen pizza mode. In a further embodiment, the cooking temperature is varied during the cooking process based on a selection by the user of the "HIGH", "MEDIUM", or "LOW" power level through input selector 143.

Referring to FIG. 4, upon initiating the fresh pizza mode, controller 152 energizes upper heating elements 124, 126 and/or lower heating element 128 to preheat 210 cooking cavity 112 to a desired temperature. During the exemplary preheating process 210, controller 152 activates upper heating elements 124, 126 and/or lower heating element 128, in an alternating sequence or continuously, for selected time periods and/or at selected temperatures. For example, as shown in FIG. 2, controller 152 energizes 212 first and second upper heating elements 124, 126 to heat the upper portion of the pizza for a selected time period, such as about 120 seconds. Controller 152 energizes 214 upper heating elements 124, 126 and lower heating element 128 for a selected time period, such as about 60 seconds. Controller 146 then energizes 216 first and second upper heating elements 124, 126 for a selected time period, such as about 60 seconds, energizes 218 second upper heating element 126 and lower heating element 128 for a selected time period, such as about 45 seconds, and energizes 220 first and second upper heating elements 124, 126 again for a selected time period, such as about 60 seconds. Controller 146 energizes 222 second upper heating element 126 and lower heating element 128 for a selected time period, such as about 45 seconds, and energizes 224 first and second upper heating elements 124, 126 for a selected time period, such as about 60 seconds.

Controller 146 energizes 226 first upper heating element 124 and lower heating element 128, and energizes 228 second upper heating element 126 and lower heating element 128 to complete the preheating process 210. In one embodiment, controller 152 performs steps 226, 228 for a selected time period. In another embodiment, controller 146 repeatedly performs steps 226, 228 until detecting a desired cooking temperature within cooking cavity 112 through sensor 132.

In the exemplary preheating process 210, first upper heating element 124 is energized to heat the inner area of the upper portion of the pizza to a first temperature. Second upper heating element 126 is energized to heat the outer area of the upper portion of the pizza to a second temperature. Toppings are generally located within the inner area of the upper portion of the pizza, and dough is generally located at the outer area. Controller 152 asynchronously energizes first and second upper heating elements 124, 126 to heat the upper portion of the pizza. For example, controller 152 alternately energizes first and second upper heating elements 124, 126 in steps 226 and/or 228. As such, the inner area is heated to a different temperature than a temperature to which the outer area of the upper portion of the pizza is heated. In one embodiment, the heated temperature of the outer area is greater than the heated temperature of the inner area. In a particular embodiment, the second temperature is approximately 800° F. to facilitate obtaining a crispy crust of the pizza. As such, the dough on the outer area may be thoroughly cooked without burning the toppings within the inner area.

Upon completion of preheating process 210, controller 152 initiates a cooking process 230. Controller 152 energizes 232 lower heating element 128 for a selected time period, such as about 46 seconds, de-energizes 234 lower heating element 128 for a selected time period, such as about 10 seconds, and then energizes 236 first and second upper heating elements 124, 126 for a selected time period, such as about 17 seconds. Controller 146 then repeats 238 steps 232 through 236 until a selected or programmed cooking time expires to terminate the fresh pizza mode. Alternatively, controller 152 may terminate the fresh pizza mode upon selection of an input selector 143, labeled as "CLEAR". Controller 152 alternately energizes upper heating elements 124, 126 and lower heating element 128 during cooking process 230. As such, the upper portion of the pizza and the lower portion of the pizza are heated at a desired temperature and/or for a desired time period for facilitating achieving the desired cooking results.

It should be apparent to those skilled in the art and guided by the teachings herein provided that that the fresh pizza mode may be executed without at least one of steps 210 through 238. Further, the cooking temperature and/or the cooking time period of each step may be varied in alternative embodiments based on different heating systems and/or cooking purposes.

Referring to FIG. 5, upon initiating the frozen pizza mode, controller 152 energizes upper heating elements 124, 126 and lower heating element 128 to preheat 310 cooking cavity 112. Preheating process 310 is substantially similar to preheating process 210 for the fresh pizza mode, as described above. Preheating process 310 may be executed without at least one of steps 212 through 228, and the time period of at least one of steps 212 through 228 may be changed to accommodate heating requirements for frozen pizza. Further, preheating process 310 may be omitted during the frozen pizza mode in alternative embodiments.

Upon completion of preheating process 310, controller 152 initiates a cooking process 320. Controller 152 energizes 322 lower heating element 128 for a selected time period, such as about 18 seconds, de-energizes 324 lower heating element 128 for a selected time period, such as about 12 seconds, and energizes 326 first and second upper heating elements 124, 126 for a selected time period, such as about 14 seconds. Controller 146 then repeats 238 steps 322 through 336 until a selected or programmed cooking time expires to terminate the frozen pizza mode. Alternatively, controller 152 may terminate the frozen pizza mode upon user manipulation of input selector 143.

In one embodiment, controller 152 provides substantially even heat through lower heating element 128 and at least one of first and second upper heating elements 124, 126 in the frozen pizza mode. More specifically, controller 152 is configured to control operation of upper heating elements 124, 126 and lower heating element 128 to energize lower heating element 128 and at least one upper heating element 124, 126 to a selected food item temperature. As such, the upper and lower portions of the pizza are substantially evenly thawed and/or cooked in the frozen pizza mode. Conversely, in one embodiment, controller 152 provides a greater amount of heat through lower heating element 128 than through upper heating elements 124, 126 in the fresh pizza mode than in the frozen pizza mode. As such, the dough of the fresh pizza may be thoroughly cooked in the fresh pizza mode.

In the exemplary embodiment, the cooking appliance heats a first area and a second area of the pizza to different temperatures and/or for different time periods. As such, the dough of the pizza may be thoroughly cooked without burning the toppings of the pizza to facilitate obtaining an optimum cooking result.

While the invention has been described in terms of various specific embodiments, those skilled in the art will recognize that the invention can be practiced with modification within the spirit and scope of the claims.

What is claimed is:

1. A heating system for a cooking appliance, the cooking appliance comprising a cabinet defining a cooking cavity, the cooking cavity configured to support a food item therein during a cooking process, said heating system comprising:

a first upper heating element and a second upper heating element positioned within said cooking cavity, said second upper heating element at least partially surrounding said first upper heating element, each of said first upper heating element and said second upper heating element positioned with respect to an upper portion of the food item;

a lower heating element positioned within said cooking cavity, said lower heating element positioned with respect to a bottom portion of the food item; and a controller operatively coupled to said lower heating element and said first and second upper heating elements, said controller configured to energize said first upper heating element and said second upper heating element to heat a first area of an upper portion of the food item to a first temperature and to heat a second area of the upper portion of the food item to a second temperature different than the first temperature.

2. A heating system in accordance with claim 1 wherein said first upper heating element is configured to heat the first area and said second upper heating element is configured to heat the second area that surrounds at least a portion of the first area, the second temperature greater than the first temperature.

3. A heating system in accordance with claim 1 wherein said controller is configured to one of alternately energize and asynchronously energize said first upper heating element and said second upper heating element.

4. A heating system for a cooking appliance, the cooking appliance comprising a cabinet defining a cooking cavity, the cooking cavity configured to support a food item therein during a cooking process, said heating system comprising:

a first upper heating element and a second upper heating element positioned within said cooking cavity, said second upper heating element at least partially surrounding said first upper heating element, each of said first upper heating element and said second upper heating element positioned with respect to an upper portion of the food item;

a lower heating element positioned within said cooking cavity, said lower heating element positioned with respect to a bottom portion of the food item; and a controller operatively coupled to said lower heating element and said first and second upper heating elements, said controller configured to energize said first upper heating element and said second upper heating element to heat the upper portion of the food item, said controller configured to energize at least one of said first upper heating element, said second upper heating element and said lower heating element in response to a selected food temperature status.

5. A heating system in accordance with claim 4 wherein said controller is operatable in one of a fresh mode and a frozen mode, said controller configured to provide more heat through said lower heating element in the fresh mode than in the frozen mode.

6. A heating system in accordance with claim 1 wherein said controller is configured to alternately energize said lower heating element and at least one of said first upper heating element and said second upper heating element.

7. A cooking appliance comprising:

a cabinet at least partially defining a cooking cavity, said cooking cavity configured to support a food item therein during a cooking process;

a first upper heating element and a second upper heating element positioned within said cooking cavity, each of said first upper heating element and said second upper heating element positioned with respect to an upper portion of the food item;

a lower heating element positioned within said cooking cavity, said lower heating element positioned with respect to a bottom portion of the food item; and a controller in operational control communication with each of said lower heating element, said first upper heating element and said second upper heating element, said controller configured to energize said first upper heating element and said second upper heating element to heat the upper portion of the food item, said first upper heating element configured to heat a first area of the upper portion of the food item to a first temperature and said second upper heating element configured to heat a second area of the upper portion of the food item to a second temperature different than the first temperature.

8. A cooking appliance in accordance with claim 7 wherein the second upper heating element is configured to surround at least a portion of said first upper heating element, and the second temperature is greater than the first temperature.

9. A cooking appliance comprising:

a cabinet at least partially defining a cooking cavity, said cooking cavity configured to support a food item therein during a cooking process:

a first upper heating element and a second upper heating element positioned within said cooking cavity, each of said first upper heating element and said second upper heating element positioned with respect to an upper portion of the food item;

a lower heating element positioned within said cooking cavity, said lower heating element positioned with respect to a bottom portion of the food item; and a controller in operational control communication with each of said lower heating element, said first upper heating element and said second upper heating element, said controller configured to energize said first upper heating element and said second upper heating element to heat the upper portion of the food item, said controller configured to energize at least one of said first upper heating element, said second upper heating element and said lower heating element in response to a selected temperature status.

10. A cooking appliance in accordance with claim 9 wherein said controller is operatable in a fresh mode and a frozen mode, said controller is configured to provide more heat through said lower heating element in the fresh mode than in the frozen mode.

11. A cooking appliance in accordance with claim 10 wherein said controller is configured to energize said lower heating element and at least one of said first upper heating element and said second upper heating element to a selected temperature in the frozen mode.

12. A cooking appliance in accordance with claim 7 wherein said controller is configured to alternately energize said lower heating element and at least one of said first upper heating element and said second upper heating element.

13. A method for operating an oven comprising:

providing a cabinet defining a cooking cavity, the cooking cavity configured to receive a food item therein;

positioning a first upper heating element, a second upper heating element and a lower heating element within the cooking cavity, each of the first upper heating element and the second upper heating element positioned with respect to an upper portion of the food item and the lower heating element positioned with respect to a bottom portion of the food item; and operatively coupling a controller to the lower heating element, the first upper heating element and the second upper heating element, the controller configured to alternately energize the first upper heating element and the second upper heating element to heat an upper portion of the food item.

14. A method in accordance with claim 13 further comprising heating an inner area of the upper portion of the food item to a first temperature, and heating an outer area of the upper portion of the food item to a second temperature different than the first temperature.

15. A method in accordance with claim 14 further comprising positioning the second upper heating element to surround at least a portion of the first upper heating element, and energizing the first upper heating element to the first temperature and energizing the second upper heating element to the second temperature greater than the first temperature.

16. A method in accordance with claim 13 further comprising alternately energizing the lower heating element and at least one of the first upper heating element and the second upper heating element.

17. A method in accordance with claim 13 further comprising operating at least one of the lower heating element, the first upper heating element and the second upper heating element in response to a selected food item temperature status.

18. A method in accordance with claim 17 wherein the controller is operatable in a fresh mode and a frozen mode, the controller is configured to provide more heat through the lower heating element in the fresh mode than in the frozen mode.

* * * * *